US010945467B2

(12) United States Patent
Wang et al.

(10) Patent No.: US 10,945,467 B2
(45) Date of Patent: Mar. 16, 2021

(54) AIR SWITCH ELECTRONIC VAPORIZER

(71) Applicant: Shenzhen Jiapin Jianyi Technology Co., Ltd, Shenzhen (CN)

(72) Inventors: Shanhong Wang, Shenzhen (CN); Charles Wong, Shanghai (CN)

(73) Assignee: Shenzhen Jiapin Jianyi Technology Co., Ltd.

( * ) Notice: Subject to any disclaimer, the term of this patent is extended or adjusted under 35 U.S.C. 154(b) by 219 days.

(21) Appl. No.: 16/259,944

(22) Filed: Jan. 28, 2019

(65) Prior Publication Data

US 2020/0237016 A1 Jul. 30, 2020

(51) Int. Cl.
*A24F 47/00* (2020.01)

(52) U.S. Cl.
CPC ..... *A24F 47/008* (2013.01)

(58) Field of Classification Search
None
See application file for complete search history.

*Primary Examiner* — Ross N Gushi
(74) *Attorney, Agent, or Firm* — Clement Cheng

(57) ABSTRACT

An air switch electronic vaporizer has a rechargeable battery heating a heating element which in turn heats a heating chamber. A control board controls the electrical heating of the heating element. An outer casing is formed as a sleeve. The outer casing retains the heating element, the rechargeable battery, and the control board. A deactivation switch can be formed as a pressure sensor. The pressure sensor can be mounted at a pressure sensor opening formed on the outer casing. The pressure sensor is configured to sense a flow of air blowing across the pressure sensor opening. The control board deactivates the intellectual heating of the heating element when the pressure sensor senses a flow of air blowing across the pressure sensor opening.

10 Claims, 5 Drawing Sheets

AIR SWITCH ELECTRONIC VAPORIZER

FIELD OF THE INVENTION

The present invention is in the field of electronic vaporizers.

DISCUSSION OF RELATED ART

A variety of different cigarette igniters have been made for a variety of different cigarettes. Cigarettes may include tobacco or other plant products. Cigarette igniters can facilitate the vaporization of cigarette material. Improved functionality of cigarette igniters can augment user experience.

SUMMARY OF THE INVENTION

An air switch electronic vaporizer has a rechargeable battery heating a heating element which in turn heats a heating chamber. A control board controls the electrical heating of the heating element. An outer casing is formed as a sleeve. The outer casing retains the heating element, the rechargeable battery, and the control board. A deactivation switch can be formed as a pressure sensor. The pressure sensor can be mounted at a pressure sensor opening formed on the outer casing. The pressure sensor is configured to sense a flow of air blowing across the pressure sensor opening. The control board deactivates the intellectual heating of the heating element when the pressure sensor senses a flow of air blowing across the pressure sensor opening.

The air switch electronic vaporizer has a heating chamber that is electrically heated by a heating needle. A top cover fits around an upper edge of the heating chamber 89, and the top cover is magnetically connected to the inner sleeve. A first sleeve can be formed as a flared flange. The first sleeve extends to a second sleeve. The second sleeve is formed as a tube. The first sleeve and the second sleeve are connected at a thermally insulating connecting ring. A bevel is formed around the pressure sensor opening. The pressure sensor is preferably a microphone. The pressure sensor provides a safety mechanism and easy method of deactivation.

Figure 1:
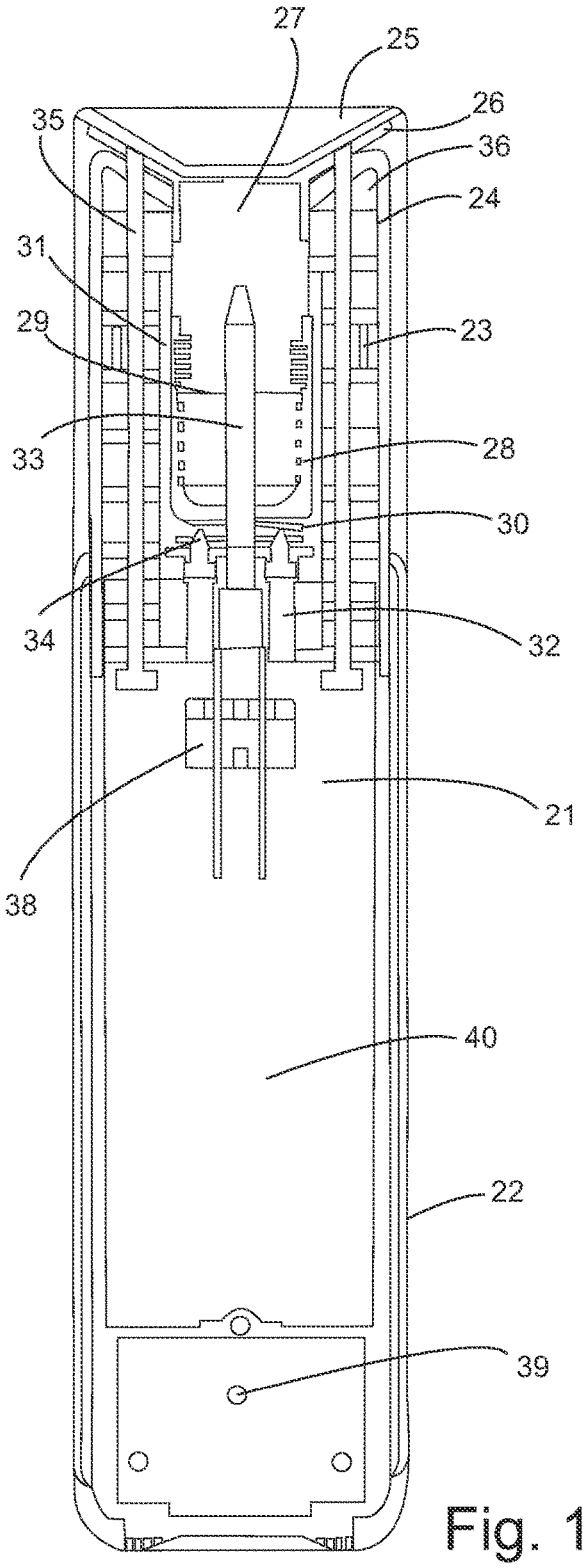
FIG. 1 is a cross-section front view of the present invention.
Figure 2:
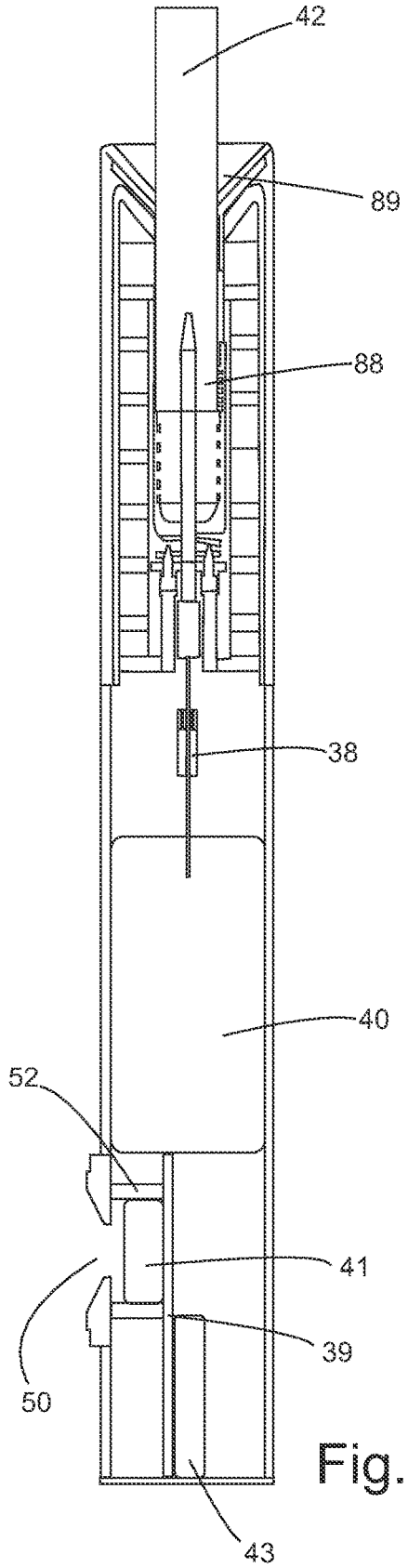
FIG. 2 is a cross-section side view of the present invention.
Figure 3:
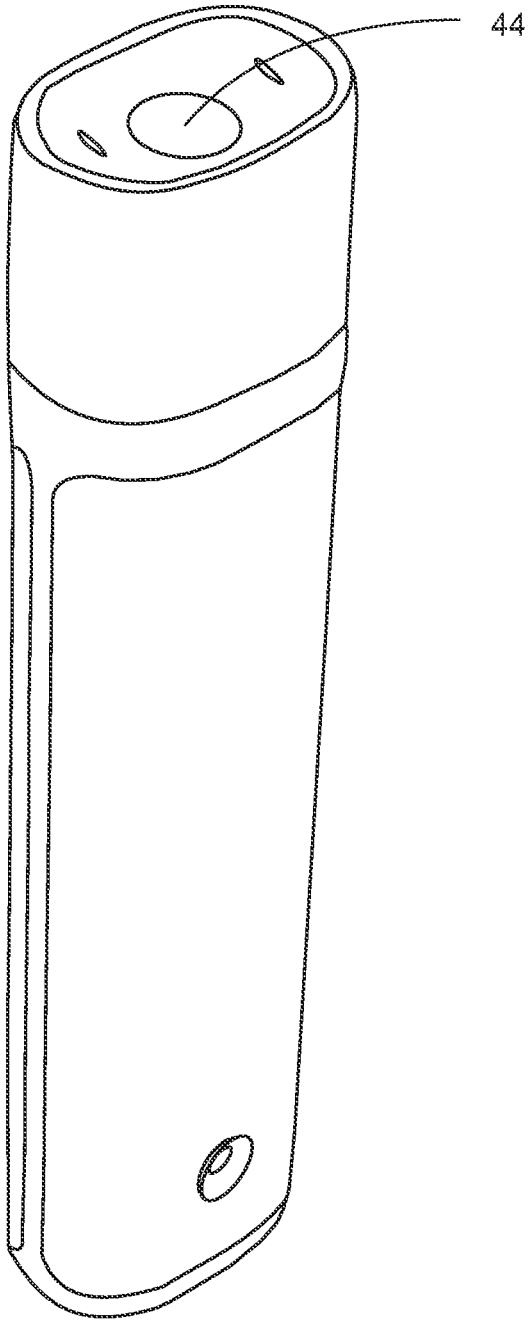
FIG. 3 is an external perspective view of the present invention.
Figure 4:
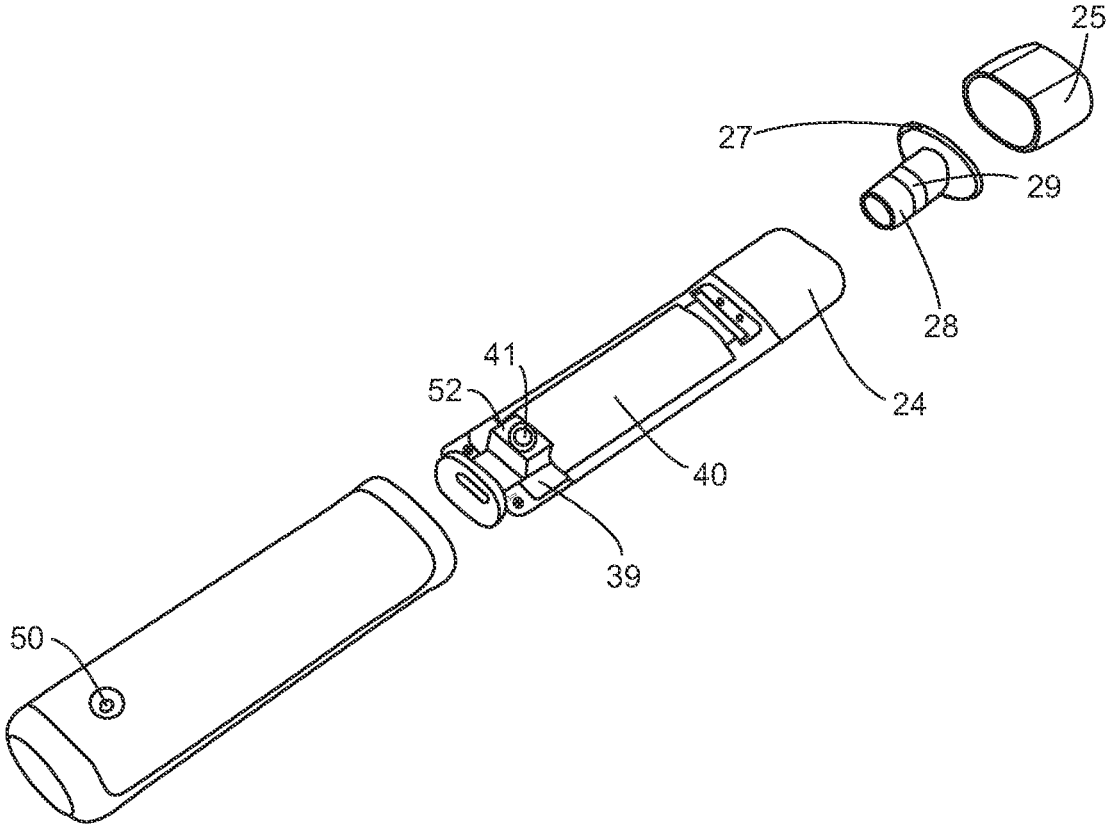
FIG. 4 is an exploded view of the present invention.
Figure 5:
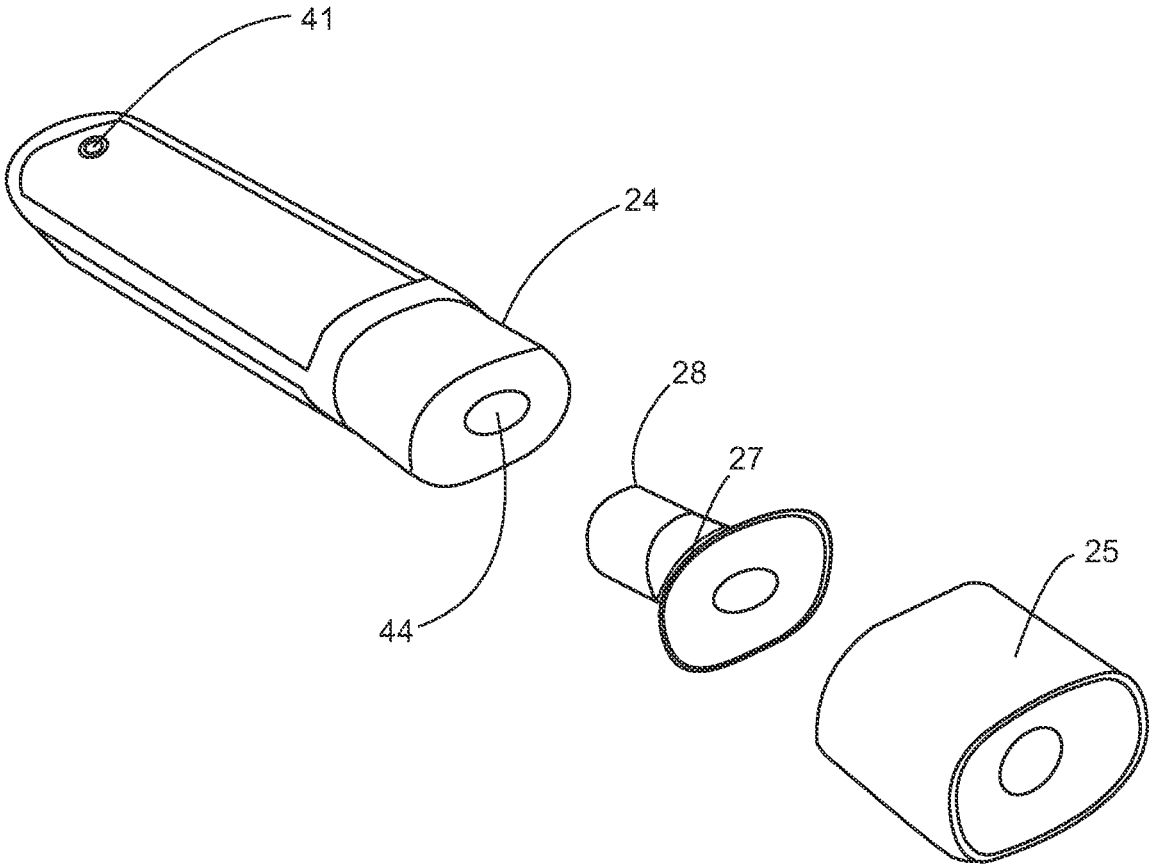
FIG. 5 is an exploded view of the present invention.
Figure 6:
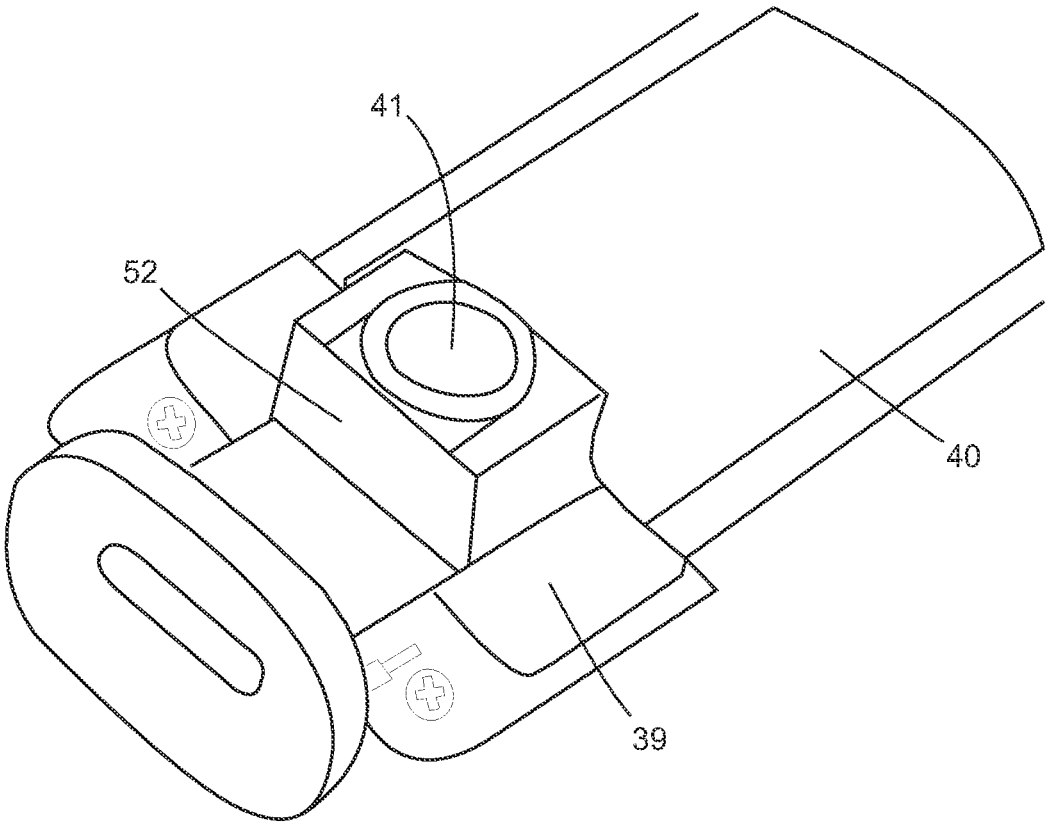
FIG. 6 is a close up view of the air switch of the present invention.

The following call out list of elements can be a useful guide in referencing the element numbers of the drawings.

21 Internal Bracket
22 Outer Casing
23 Bracket Cover
24 Inner Sleeve
25 Top Cover
26 Magnetic Sheet
27 First Cover
28 Second Cover
29 Connecting Ring
30 Spring
31 Insulation Sleeve

32 Heater Seat
33 Heating Needle
34 Sensor Needle Tip
35 Light Guide Column
36 Magnet
38 Control Board
39 USB Board
40 Battery
41 Microphone
42 Plant Based Cigarette
43 USB Socket
44 Cigarette Opening
50 Microphone Opening
51 Bevel
52 Microphone Holder
88 Heating Chamber
89 Heating Chamber Upper Edge

DETAILED DESCRIPTION OF THE PREFERRED EMBODIMENT

The present invention, as seen in the figures, is a cigarette igniter which includes a rechargeable battery 40 that powers a heating needle 33 for heating a plant based cigarette 42. The battery 40 can be recharged by a USB socket 43. The USB socket 43 is formed on the USB board 39.

The cigarette igniter can have an internal bracket 21 that holds the battery and heating needle 33 and USB board 39 on a tray structure that slides into an outer casing 22. The outer casing 22 can be formed as an aluminum sleeve. The internal bracket 21 can also be made of aluminum for improving heat dissipation. A bracket cover 23 can cover the internal bracket 21. If the internal bracket 21 is formed as a tray, then the bracket cover 23 can cover the tray.

The inner sleeve 24 is formed toward a tip of the cigarette igniter and has a cigarette opening 44 formed in it. The cigarette opening 44 receives a plant based cigarette 42. The top cover 25 fits over the inner sleeve 24. The inner sleeve 24 preferably has a pair of magnets 36 mounted on it that attracts to a magnetic sheet 26 located on the top cover 25. The inner sleeve 24 is preferably connected to the internal bracket 21 at a lower end of the inner sleeve 24.

A second cover 28 is formed as a downward extension of the first cover 28. The second cover 28 can be formed as a tube that is connected to the first cover 27 which is formed as a flared flange. A connecting ring 29 can connect the first cover to the second cover. Preferably, the connecting ring 29 is a thermal break that prevents heat from transmitting from the second cover 28 to the first cover 27.

A spring 30 is mounted toward a base of the heating needle 33 so that sensor needle tips 34 mounted on heater seats 32 can detect insertion of a cigarette. Once the cigarette is inserted, the heating needle 33 begins to heat, and the heat generated through electrical resistance of the heating needle 33 is held within the heating chamber 88 by an insulation sleeve 31. The insulation sleeve 31 forms a thermal break between the heating portion and the battery 40. The sensor needle tips 34 are contact switches that are activated when a downward movement of the cigarette completes a circuit. A control board 38 senses the circuit completion.

Additionally, a microphone 41 or other diaphragm pressure sensor can be electrically connected to the USB board so that the microphone 41 receives a flow of air or air pressure disturbance from a microphone opening 50. A user can blow on the microphone. When the microphone senses air vortices around the bevel 51 of the microphone opening 50, the control board 38 deactivates the heating needle 33.

Thus, the user can blow on the microphone opening 32 that can deactivate the heating needle 33. The microphone is preferably held within a microphone holder 52 formed of a soft plastic that isolates the microphone from the user during use. Thus, a user can deactivate the cigarette by softly blowing on the microphone switch. The microphone can be implemented by a diaphragm pressure sensor or a audio microphone element commonly found in consumer electronics. The microphone switch is an air activated deactivation switch that is in a different and separated stream of air flow than the cigarette. Triggering of the air switch overrides the cigarette insertion switch so that heating needle 33 turns off even if the cigarette is inserted. In windy weather, the microphone opening 50 is shaped so that the user can put a finger over the microphone opening 50 to cover it from inadvertent wind deactivation. If the user were to accidentally drop the device, the rush of air across the microphone opening 50 or the sound of the impact could deactivate the cigarette to provide a safety mechanism.

The airflow along the bevel 51 generates vortices that the audio microphone element is, attuned to listen to. The control board 38 is connected to the microphone 41 so that the control board 38 can filter out other sounds and pressure disturbances and only pick up on the air vortices generated when blowing across the bevel 51. This prevents the device from accidentally deactivating during use. The bevel 51 can be configured to generate resonance such as Helmholtz, or can be configured to direct air toward the pressure sensor.

An indicator such as an LED on the control board 38 can indicate to the user the status of the heating needle 33. The LED can be connected such as by a prism. An example of a prism is the light guide column 35 that can direct the LED light to the exterior of the device. The USB board 39 can connect to the control board 38 by a cable for providing data access. The USB socket 43 is formed in a lower portion of the outer casing 22. Optionally, the microphone can output audio to the USB port.

The invention claimed is:

1. An air switch electronic vaporizer comprising:

a. a rechargeable battery heating a heating element which in turn heats a heating chamber;

b. a control board controlling the electrical heating of the heating element;

c. an outer casing formed as a sleeve, wherein the outer casing retains the heating element, the rechargeable battery, and the control board; and d. a deactivation switch formed as a pressure sensor, wherein the pressure sensor is mounted at a pressure sensor opening formed on the outer casing, wherein the pressure sensor is configured to sense a flow of air blowing across the pressure sensor opening, wherein the control board deactivates the heating of the heating element when the pressure sensor senses a flow of air blowing across the pressure sensor opening.

2. The air switch electronic vaporizer of claim 1, wherein the heating chamber is electrically heated by a heating needle.

3. The air switch electronic vaporizer of claim 1, wherein a top cover fits around an upper edge of the heating chamber, wherein the top cover is magnetically connected to the inner sleeve.

4. The air switch electronic vaporizer of claim 1, further including a first sleeve formed as a flared flange, wherein the first sleeve extends to a second sleeve, wherein the second sleeve is formed as a tube, wherein the first sleeve and the second sleeve are connected at a thermally insulating connecting ring.

5. The air switch electronic vaporizer of claim 1, further including a bevel formed around the pressure sensor opening.

6. The air switch electronic vaporizer of claim 1, wherein the pressure sensor is a microphone.

7. The air switch electronic vaporizer of claim 6, wherein the heating chamber is electrically heated by a heating needle.

8. The air switch electronic vaporizer of claim 6, wherein a top cover fits around an upper edge of the heating chamber, wherein the top cover is magnetically connected to the inner sleeve.

9. The air switch electronic vaporizer of claim 6, further including a first sleeve formed as a flared flange, wherein the first sleeve extends to a second sleeve, wherein the second sleeve is formed as a tube, wherein the first sleeve and the second sleeve are connected at a thermally insulating connecting ring.

10. The air switch electronic vaporizer of claim 6, further including a bevel formed around the pressure sensor opening.

* * * * *